US011109659B2

(12) United States Patent
Bruder

(10) Patent No.: US 11,109,659 B2
(45) Date of Patent: Sep. 7, 2021

(54) LIQUID DISPENSER WITH DISCHARGE SPONGE

(71) Applicant: APTAR RADOLFZELL GMBH, Radolfzell (DE)

(72) Inventor: Thomas Bruder, Constance (DE)

(73) Assignee: APTAR RADOLFZELL GMBH, Radolfzell (DE)

( * ) Notice: Subject to any disclaimer, the term of this patent is extended or adjusted under 35 U.S.C. 154(b) by 86 days.

(21) Appl. No.: 16/485,588

(22) PCT Filed: Feb. 15, 2018

(86) PCT No.: PCT/EP2018/053832
§ 371 (c)(1),
(2) Date: Aug. 13, 2019

(87) PCT Pub. No.: WO2018/171986
PCT Pub. Date: Sep. 27, 2018

(65) Prior Publication Data

US 2020/0000202 A1 Jan. 2, 2020

(30) Foreign Application Priority Data

Mar. 20, 2017 (EP) ..... 17161832

(51) Int. Cl.
*B43K 5/00* (2006.01)
*A45D 34/04* (2006.01)
(Continued)

(52) U.S. Cl.
CPC ..... *A45D 34/043* (2013.01); *A45D 40/264* (2013.01); *B43K 1/006* (2013.01);
(Continued)

(58) Field of Classification Search
CPC ..... A45D 34/043; A45D 40/264; A45D 2200/1009; A45D 2200/1018
(Continued)

(56) References Cited

U.S. PATENT DOCUMENTS 3,054,134 A 9/1962 Meyerhoefer
5,411,345 A * 5/1995 Ueji ..... B43K 5/1845 401/199
(Continued)

FOREIGN PATENT DOCUMENTS

BE 504612 A 7/1951
DE 172226 C 6/1906
(Continued)

OTHER PUBLICATIONS

International Search Report issued in International Application No. PCT/EP2018/053832, with English translation, dated Mar. 2, 2018 (7 pages).
(Continued)

*Primary Examiner* — Jennifer C Chiang
(74) *Attorney, Agent, or Firm* — Flynn Thiel, P.C.

(57) ABSTRACT

A discharge head for a liquid dispenser for discharging cosmetic products which has a base to be secured to a liquid storage. The base has a coupling device in the form of a thread or a latching coupling device, for coupling to the liquid storage. The discharge head has a sponge carrier with a sponge receptacle in which a sponge is arranged. The sponge carrier is movable in a translationally guided manner with respect to the base and has a hollow connector inside which a liquid channel is provided that connects the liquid storage to the sponge receptacle. This liquid channel is provided with an outlet valve, which is opened by moving
(Continued)

the sponge carrier in the direction of the base, such that liquid can flow freely out of the liquid storage into the sponge receptacle.

18 Claims, 5 Drawing Sheets

(51) Int. Cl.
*B43K 1/00* (2006.01)
*B43K 1/01* (2006.01)
*A45D 40/26* (2006.01)

(52) U.S. Cl.
CPC ..... *B43K 1/01* (2013.01); *A45D 2200/1009* (2013.01); *A45D 2200/1018* (2013.01)

(58) Field of Classification Search
USPC ..... 401/206, 263, 264, 272, 273
See application file for complete search history.

(56) References Cited

U.S. PATENT DOCUMENTS

| | | | | |
|---|---|---|---|---|
| 5,692,846 | A * | 12/1997 | Schwarzberg | A47L 23/05 401/190 |
| 6,347,899 | B1 | 2/2002 | Vierboom | |
| 6,592,282 | B2 | 7/2003 | Fontanet et al. | |
| 6,682,246 | B2 * | 1/2004 | Reggiani | B65D 83/285 401/183 |
| 7,004,659 | B1 * | 2/2006 | Goodman | B05C 17/002 222/633 |
| 8,757,914 | B1 | 6/2014 | Megaro et al. | |
| 9,848,685 | B2 * | 12/2017 | Hwang | A45D 34/042 |

FOREIGN PATENT DOCUMENTS

| | | | |
|---|---|---|---|
| DE | 1143981 | B | 2/1963 |
| EP | 0037903 | A1 | 10/1981 |
| EP | 0127453 | A2 | 12/1984 |
| EP | 0315513 | A1 | 5/1989 |
| EP | 0374339 | A1 | 6/1990 |
| EP | 0875465 | A1 | 4/1998 |
| EP | 1002736 | A2 | 5/2000 |
| EP | 1346927 | A2 | 9/2003 |
| JP | H04279459 | A | 10/1992 |
| WO | 9410056 | A1 | 5/1994 |
| WO | 2007100188 | A1 | 9/2007 |

OTHER PUBLICATIONS

Written Opinion of International Searching Authority issued in International Application No. PCT/EP2018/053832, dated Mar. 2, 2018 (7 pages).

* cited by examiner

LIQUID DISPENSER WITH DISCHARGE SPONGE

FIELD OF USE AND PRIOR ART

The invention relates to a discharge head for a liquid dispenser for discharging cosmetic liquids, in particular for a liquid dispenser configured as a sponge-type dispenser.

A discharge head of the type in question has a base to be secured to a liquid storage means, the base having a coupling device, in particular in the form of a thread or a latching coupling device, for coupling to the liquid storage means. This base is intended to be secured to a suitably configured liquid storage means in which the liquid is stored free of pressure.

The discharge head moreover has an applicator portion which, in the case of a sponge-type dispenser, is configured as a sponge carrier and has a sponge receptacle in which a sponge is arranged.

U.S. Pat. No. 6,592,282 B2 discloses a sponge-type dispenser in which a discharge head as a whole is movable, in order thereby to actuate a pump of the sponge-type dispenser. U.S. Pat. No. 5,692,846 and EP 0374339 A1 disclose sponge-type dispensers in which the sponge is movable in order to actuate a bottle-integrated pump or to open a bottle-integrated aerosol valve of an assigned pressurized container. EP 1002736 A2 likewise discloses a sponge-type dispenser which is attached to a pressurized gas pack with spray valve. DE 1143981 B discloses a dispenser in which a sponge is configured to be movable and, depending on its position, can be supplied with liquid from a liquid storage means via grooves lying on the outside. EP 0875465 A1 discloses a sponge-type dispenser with two valves which together delimit a dosing chamber and which can be opened and closed by pressing the sponge in, such that a pre-dosed amount of liquid is supplied to the sponge. JP H04-279459 A, WO 94/10056 A1, EP127453 B1, EP 1346927 A2 and EP 0315513 A1 disclose systems which have sponges integrated fixedly in the discharge head and in which a valve for supplying the sponge with liquid can be opened when pressure is applied to the sponge.

None of the known systems combines, in a desired manner, the advantages of simple handling and of continuous supply of liquid to the sponge, while at the same time effectively avoiding unwanted escape of liquid and ensuring low manufacturing costs.

OBJECT OF THE INVENTION

The object of the invention is to make available a discharge head which is usable in particular for sponge-type dispensers and which, while being easy to produce, permits continuous and safe discharge of liquid via a sponge.

In order to achieve this object, provision is made, according to a first aspect of the invention, that the sponge carrier is movable in a translationally guided manner with respect to the base and has a hollow connector inside which a liquid channel is provided that connects the liquid storage means to the sponge receptacle. This liquid channel is assigned an outlet valve which can be opened by moving the sponge carrier in the direction of the base, such that liquid can flow freely out of the liquid storage means into the sponge receptacle, so as to be taken up by the sponge for subsequent dispensing in particular to the skin of a user.

The whole sponge carrier of such a discharge head according to the invention is movable in translation with respect to the base and, for this purpose, is guided in translation on the base. This movement from a starting position to a pressed-in position causes the outlet valve to open, such that the sponge can be supplied with liquid through the hollow connector.

In contrast to many designs from the prior art, no deformation of the sponge itself is necessary in order to open the outlet valve. This decoupling leads to considerably greater freedom in the choice of the sponge. For example, a relatively hard sponge can be used which barely deforms at all under the force when pressed onto the skin and instead is moved only jointly with the rigid sponge carrier, such that the outlet valve opens. The design concept with a movable sponge carrier thus also facilitates continuous supply of liquid to the sponge.

The outlet valve, which can be opened by movement of the sponge carrier and of the hollow connector, is the sole valve between the liquid storage means and the sponge. When the outlet valve is opened by pressing the sponge carrier inward, and with the dispenser suitably oriented, the liquid can thus flow continuously, without any further application of pressure, to the sponge receptacle and can feed the sponge there. The flow of liquid with which the sponge is fed depends on the degree of opening of the valve when the sponge carrier is pressed in and, in the case of a discharge head with a spring mechanism as described further below, also on the pressing force and on the angle of inclination of the dispenser as a whole, and it can therefore be efficiently metered.

The sponge can be a sponge that is customary in the cosmetics field, for example made of cellulose or cotton fibers. Sponges that are only slightly deformable are seen as being preferred for a discharge head according to the invention, particularly in customary applications. The sponge is part of the sponge carrier and can be mounted firmly on the latter and exchangeably for the end user. In particular, the sponge can be received in a bowl-shaped sponge receptacle and can be held there purely by force-fit engagement. The liquid channel provided in the hollow connector preferably opens directly into the sponge receptacle.

The hollow connector, movable as part of the sponge carrier with respect to the base and having the integrated liquid channel, creates the connection between the liquid storage means and the sponge receptacle. At least in the pressed-in state of the sponge carrier, the hollow support preferably extends beyond a sealing plane between liquid storage means and discharge head and, with the liquid storage means coupled, thus extends into the latter, and therefore no further liquid-conveying components have to be provided.

The hollow connector also preferably serves for movable securing to the base, in particular since it is secured at one end, in a manner described below, to a spring mechanism or sealing element or is secured captively to the base by form-fit engagement. In particular, the hollow connector can be constructed from two or more components, as is also described in more detail below.

The base, or a spring mechanism provided on the base, can have an aperture through which the hollow connector of the sponge carrier protrudes. The sponge carrier, at an end of the hollow connector directed away from the sponge receptacle, can have a widened part which, by form-fit engagement, counters a separation of the base or spring mechanism from the sponge carrier. In the case of securing to the spring mechanism, the hollow connector is positionally fixed at the aperture of the spring mechanism by means of the widened part. In the case of securing to an aperture of the base, the hollow connector and with it the entire sponge carrier are secured displaceably on the base. By means of the hollow connector with the widened part at one end, this movable securing of the sponge carrier to the base is obtained in a particularly simple way.

In particular, the sponge carrier can have two separate components which are mounted on each other in a positionally fixed manner and together form the hollow connector. A first of the two components of the sponge carrier has the sponge receptacle and, extending from the latter, an outer sleeve of the hollow connector. A second of the two components has the widened part. In this way, a form-fit coupling to the base or to the spring mechanism can be easily produced during assembly, with the two components of the sponge carrier which together form the hollow connector being joined together, while the base or the spring mechanism secured to the base is positioned between them with the aperture.

The use of two components for forming the hollow connector is also advantageous since in this way it is easily possible to form, between the two components, the inlet through which liquid can pass into the liquid channel. The inner of the two components, in particular the component forming the widened part at the end of the hollow connector, can be configured as a partially slit component, wherein the slit can form the liquid channel in the hollow connector.

In particular, the two components can be connected to each other by a latch connection, wherein particularly preferably the first component has the hollow connector and the second component has a latching portion which engages through the hollow connector and/or is latched inside the hollow connector. Said partially slit design is also advantageous for this latching, since in this way latching elements on two sub-portions of the slit component can be deflected toward each other by slight force for assembly purposes.

Provision is preferably made that the discharge head has a spring mechanism by means of which the sponge carrier of the discharge head is subjected to a force directing it away from the base. The spring force of this spring mechanism essentially determines with which force the sponge carrier has to be depressed in order to open the outlet valve. In particular, a soft spring can be used here which is able to deflect even under a force at which no real deformation of the sponge takes place. Thus, the supply of liquid to the sponge can be controlled without negative tangential compression of the latter.

In a particularly simple variant of a spring mechanism, provision is made that the spring mechanism is configured as a simple helical spring which acts between the sponge carrier and the base and is arranged outside of the hollow connector. Since such a spring is not in contact with liquid, it can be configured as a metal spring. However, a configuration as a plastic spring is also possible.

In another variant of said spring mechanism, the spring mechanism has an elastically deformable spring plate with a central elevation, which spring plate is secured in an outer region to the base and is secured in the region of the elevation to the sponge carrier, in particular to the hollow connector thereof. Such a spring is very cost-effective and is also suitable in a discharge head according to the invention, since there is no need here for a long excursion of the sponge carrier with respect to the base. Moreover, such a spring mechanism in the form of a spring plate with an elevation can also assume further functions. Thus, such a spring mechanism can be made of a flexible, elastic plastic material which is also suitable at the same time as a bottle seal and moreover can also form a valve face of the outlet valve. This is explained in more detail below. The spring mechanism is preferably produced from a different plastic than the base, but it can also be formed in one piece with the base by multi-component injection molding.

Preferably, an aperture is provided in the spring plate in the region of the elevation, through which aperture liquid is conveyed to the sponge receptacle. The aperture can in particular also serve to secure the hollow connector in the manner mentioned above.

The discharge head can have a ventilation channel, by means of which compensating air can flow from an environment into the liquid storage means after removal of liquid. It is also possible in principle to do without a separate ventilation channel, since air can pass through the sponge and the liquid channel into the liquid storage means. However, it has been found that, for dispensing liquid via the sponge, it can be advantageous if air flows in by a separate path. The provision of a separate ventilation channel is also advantageous for preventing a situation where, on account of the air permeability of the sponge being reduced by liquid, an underpressure forms in the liquid storage means and makes supply of liquid to the sponge difficult.

The ventilation channel does not have to be separated completely from the liquid path. However, it is particularly advantageous if it is provided as a separate ventilation channel in the region of an environment of the sponge. For this purpose, a sub-portion of the ventilation channel can in particular be provided between the sponge and a surface of the sponge receptacle facing toward the sponge, in particular by a groove introduced into the surface and/or into the sponge. Such a groove preferably extends from an edge region of the sponge receptacle to the liquid channel in the hollow connector. It can be very easily produced in particular as a groove in the sponge receptacle.

Although a completely separate ventilation channel is also possible, it is structurally advantageous if a sub-portion of the ventilation channel is formed by the liquid channel. It is particularly advantageous if the ventilation channel in the region of the outlet valve is formed together with the liquid path, such that the outlet valve suppresses both the flow of liquid into the liquid channel and also the ventilation of the liquid storage means. It is particularly advantageous if the ventilation channel, from an environment-side inlet to a liquid storage means outlet, has a greater length than the liquid channel from the liquid storage means inlet to the sponge-side outlet.

Since, in a discharge head according to the invention, the supply to the sponge is not effected by a compression of the latter but instead by a movement of the sponge carrier, it is possible to use a relatively hard sponge, in particular a sponge made of a material marketed under the trade name POREX, and/or of a porous plastic material. The sponge can have a Shore A hardness of at least 40, preferably of at least 60, particularly preferably of at least 80. By virtue of its inherent stability, such a sponge permits a particularly targeted discharge of liquid.

A liquid dispenser with the discharge head according to the invention is intended to be oriented at a slight downward inclination during its intended use. However, to be able to obtain effective discharge on somewhat vertical surfaces, it can be advantageous if the sponge, at an application face, is inclined with respect to a direction of movement of the sponge carrier, wherein preferably at least 50% of the application face is inclined at a uniform angle, particularly preferably inclined in such a way that a normal vector on the application face encloses an angle of between 10° and 30° with the direction of movement of the sponge carrier.

The shape of the sponge can also be specially configured in a cross-sectional plane of the sponge extending orthogonally with respect to the direction of movement of the sponge carrier. This is favored in particular by the preferred comparatively rigid configuration of the sponge. For example, a shape can be provided which deviates from a circular shape and a rectangular shape, particularly preferably an elliptical shape, a polygonal shape or the shape of a heart or of another motif. Such a shape can serve esthetic purposes. In addition, however, the shape can also favor particularly targeted discharge.

According to a second aspect of the invention, a discharge head of the type mentioned at the outset is provided which has a base and an applicator portion, particularly in the form of a sponge carrier, which is movable in a translationally guided manner with respect to the base. The applicator portion has a hollow connector inside which a liquid channel is provided by way of which the applicator portion can be fed with liquid from the liquid storage means. The discharge head is assigned at least one outlet valve for interrupting the supply of liquid to the applicator portion.

In an embodiment according to this second aspect, the discharge head has a one-piece sealing component on the coupling device, said sealing component having a peripheral bottle-sealing portion by which, when the liquid storage means is coupled, a contact region between base and liquid storage means is sealed off from an environment and is as it were clamped between base and liquid storage means. This sealing component has an inner sealing portion which interacts with the hollow connector in such a way that a sliding sealing face on the inner sealing portion interacts with an outer face of the hollow connector in such a way that, during translational movement of the hollow connector with respect to the inner sealing portion, no liquid can flow between the sliding sealing face and the outer face of the hollow connector, and/or that a valve body face provided on the hollow connector bears, in an end position of the applicator portion, on a valve sealing face of the inner sealing portion in such a way that the delivery channel is thereby interrupted.

This second aspect of the invention is preferably realized together with the first aspect, wherein said one-piece sealing component is identical to the spring mechanism with spring plate or at the same time forms a seal for the hollow connector. A discharge head according to the second aspect of the invention is preferably likewise formed with a sponge carrier with sponge as applicator portion, although it can in principle also be designed for another type of application, for example in the manner of a cosmetic dispenser stick. The details given above for the first aspect of the invention can also be realized, jointly or individually, in the case of a discharge head according to this second aspect of the invention with a sponge carrier with sponge.

The inventive step according to the second aspect of the invention is that the sealing component, which by means of a bottle-sealing portion ensures the sealed mounting of the discharge head on the liquid storage means, assumes further functions, and therefore the discharge head can have few components.

These further functions can in particular include the fact that an inner sealing portion of the sealing component bears on the outside of the hollow connector, by means of the sliding sealing face provided there, and unwanted escape of liquid is thus prevented here when the hollow connector is moved with respect to the base.

Above all, however, the inner sealing portion of the sealing component can form a valve sealing face on which, in the closed state of the outlet valve, a valve body face of the hollow connector bears and thus closes the outlet valve.

Two configurations in particular are conceivable here. In the first configuration, the hollow connector has at one end a widened part on which the valve body face is provided. If the hollow connector is moved with the valve body face, this valve body face can be lifted away from the valve sealing face of the inner sealing portion, such that a gap forms between valve sealing face and valve body face, through which gap the liquid can flow into the hollow connector. In such a configuration, the sealing component can be designed as a simple, flat sealing ring, of which the external diameters are adapted to the dimensions of the base and of the liquid storage means, and of which the internal diameters are defined by the outer dimensions of the hollow connector and of its widened part.

Alternatively, the hollow connector is secured on the inner sealing portion of the sealing component, and this inner sealing portion of the sealing component has for this purpose a sealing structure which rises above the plane of the bottle-sealing portion and which defines an interior. The valve body face on the hollow connector is provided on a valve portion of the hollow connector arranged in said interior defined by the sealing structure.

In such a configuration, the valve body face does not lift away from the stationary sealing component as in the preceding configuration, and instead the sealing component partially experiences a deformation, namely in the region of the sealing structure rising above the bottle-sealing portion. This sealing structure is preferably dome-shaped, and, in the closed state of the outlet valve, the valve body face on the hollow connector bears inwardly on this preferably dome-like structure. The movement of the hollow connector causes a deformation of the sealing structure, as a result of which its walls lose contact with the valve body face, such that liquid can flow into the hollow connector.

For use with a discharge head of the type described, the invention also relates to a liquid dispenser for discharging cosmetic liquids. This liquid dispenser has a liquid storage means with a coupling nozzle for coupling to a discharge head, and it has a discharge head with a coupling device for coupling to the liquid storage means. This discharge head is configured in accordance with the above description and is therefore particularly preferably configured as a discharge head with sponge carrier and sponge.

The liquid storage means for the invention, with a discharge head according to the invention, is intended to be filled with cosmetic liquid such as a makeup liquid, which is present here for example under ambient pressure, i.e. is not pressurized by propellant gas or by other means of discharge. A discharge head according to the invention is not provided for use of such a pressurized container. Instead, with the non-pressurized liquid dispenser oriented at a suitable inclination, the liquid flows by gravity in the direction of the outlet nozzle of the liquid storage means and, with the outlet valve opened, flows into the attached applicator portion, in particular into the sponge carrier.

The liquid dispenser preferably has a coupling nozzle for mounting the discharge head, in particular with an outer thread or with a geometry suitable for latching. Besides these form-fit coupling methods, a purely frictional engagement is also conceivable in principle.

The liquid storage means is preferably a plastic bottle or glass bottle, and the discharge head is secured on the bottle neck and surrounds the bottle neck.

Preferably, the liquid storage means has a wall which is substantially rotationally symmetrical, or plane-symmetrical with respect to at least two planes, and which defines a central axis of the liquid storage means. The discharge head and the liquid storage means are configured and adapted to each other in such a way that, with the outlet valve opened and with the discharge head oriented such that the central axis encloses an angle of 15° with the horizontal, falling in the direction of the discharge head, at least 90% of the liquid, starting from a completely filled liquid storage means, can flow out through the outlet valve and a maximum of 10% remains as residual liquid in the liquid storage means.

To achieve such a small amount of residual liquid, it is advantageous if the preferably bottle-like liquid storage means has a slim shape. It is particularly advantageous if the maximum internal diameter of the preferably mainly cylindrical interior of the liquid storage means is at most 2.5 times the diameter of an outlet opening of the liquid storage means, in particular between 1.5 and 2 times said diameter. It is moreover advantageous if a transition structure is provided between the maximum diameter and the outlet opening of the liquid storage means, for example a conical formation, or a multi-stepped taper, in order to keep the amount of residual liquid low.

BRIEF DESCRIPTION OF THE DRAWINGS

Further advantages and aspects of the invention will become clear from the claims and from the following description of preferred illustrative embodiments of the invention, which are explained below with reference to the figures.

DETAILED DESCRIPTION OF THE ILLUSTRATIVE EMBODIMENTS

Figure 1:
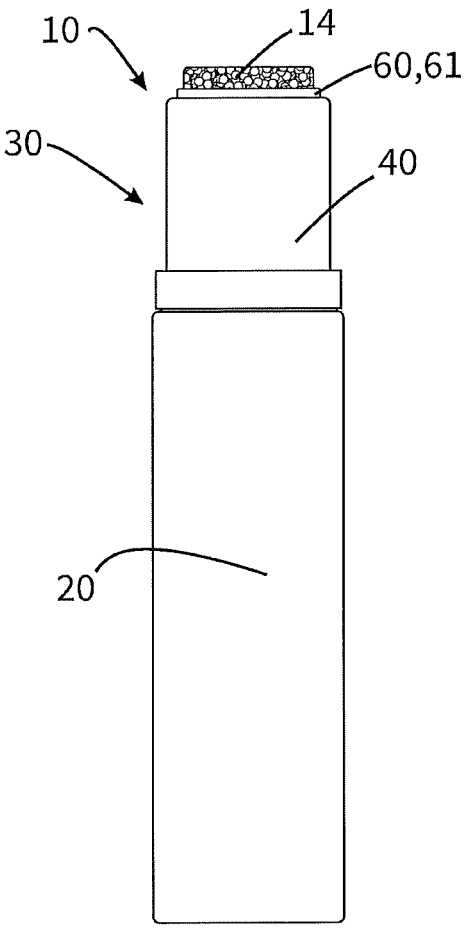
FIGS. 1 and 2 show a sponge-type dispenser according to the invention from the outside, in the inactivated state and in the activated state.
Figure 2:
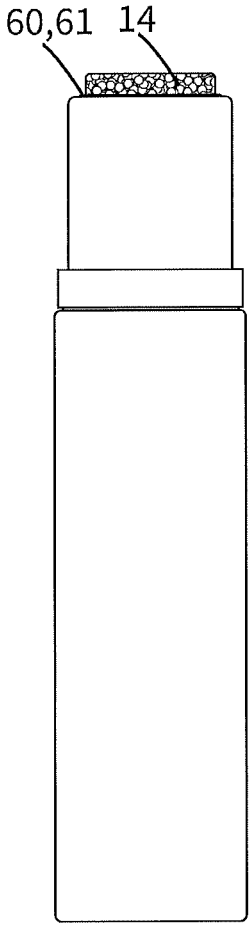

FIGS. 1 and 2 show an illustrative embodiment of a liquid dispenser 10, which is configured as a sponge-type dispenser.

The liquid dispenser 10 has a liquid storage means 20 which is configured as a slim plastic bottle, with a discharge head 10 mounted on its coupling nozzle 22 that forms the bottle neck. This discharge head 30 for its part has a base 40 with a coupling device 44 provided for coupling to the coupling nozzle 22. A sponge carrier 60, forming an applicator portion 61, is movable in translation with respect to this base 40. This sponge carrier 60 has a sponge receptacle 64 in which a sponge 14 is arranged.

FIGS. 1 and 2 show the stated mobility. As can be seen, in the illustrative embodiment shown the sponge carrier 60 can be deflected only over a relatively short distance of a few millimeters.

The depression of the sponge carrier 60 and sponge 14, as shown in FIG. 2, has the effect that an outlet valve 86 to be explained in detail below is opened, such that liquid can pass from the liquid storage means 20 into the sponge receptacle 64 and into the sponge 14.

Figure 3:
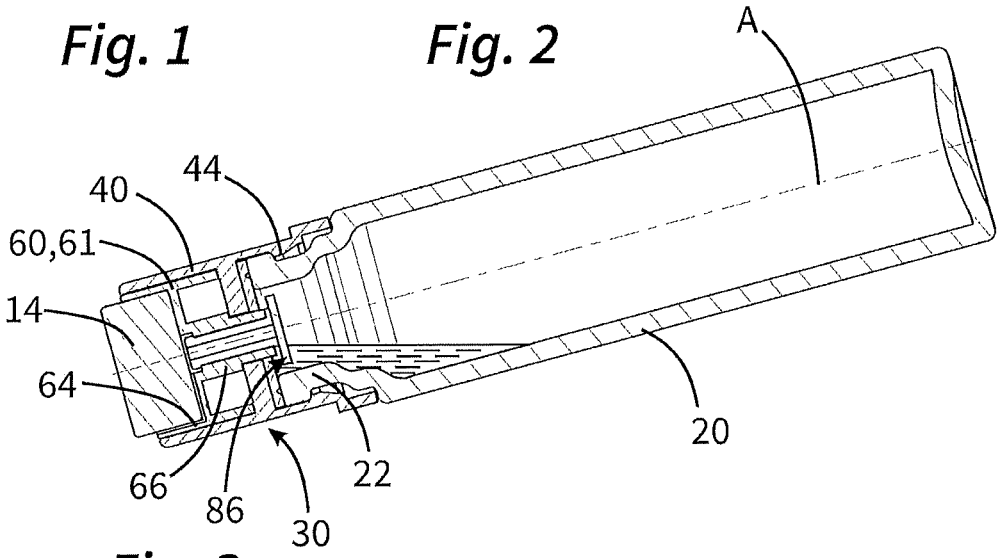
FIG. 3 shows by way of example a sectional view of such a sponge-type dispenser in an orientation customary for use.

FIG. 3 illustrates an example of this. For its intended use, the liquid dispenser 10 is brought to an orientation in which it slopes slightly downward in the direction of the sponge 14. Then, by pressing the sponge 14 onto the skin in this orientation, the outlet valve 86 is opened and liquid from the liquid storage means 20 can flow freely through a hollow connector 66 into the sponge receptacle 64 and is taken up there in the sponge 14 for the purpose of being discharged. As FIG. 3 also illustrates, the shape and in particular the slim configuration of the liquid storage means 20 ensures that, even when the liquid dispenser 10 is held with only a slight downward orientation, almost the entire liquid volume in the liquid storage means 20 can be discharged. The residual amount, which in the illustrative embodiment of FIG. 3 remains in the liquid storage means, is less than 3% of the original amount of liquid.

Figure 4:
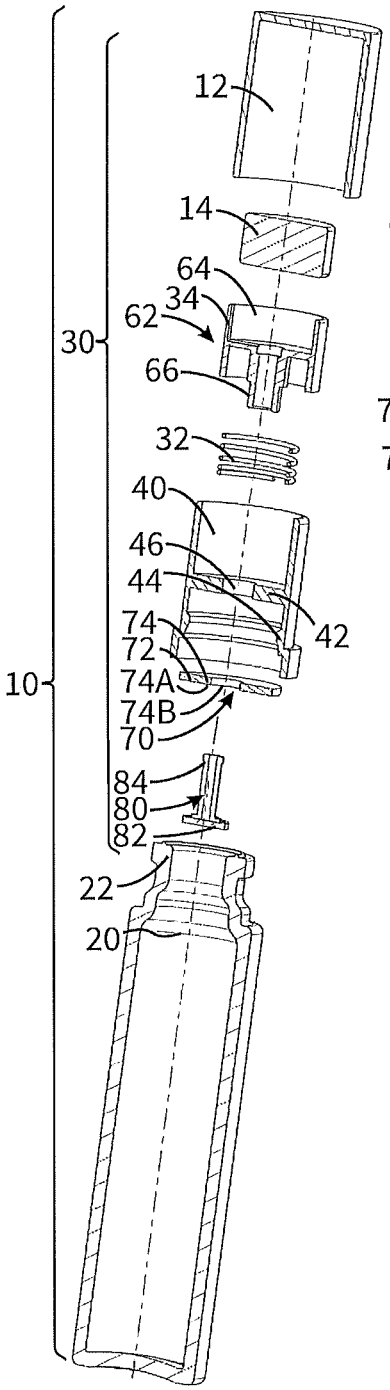
FIGS. 4 to 6 show a first variant of a sponge-type dispenser according to the invention in an exploded view and in sectional views in the state with the outlet valve closed and in the state with the outlet valve opened.
Figure 5:
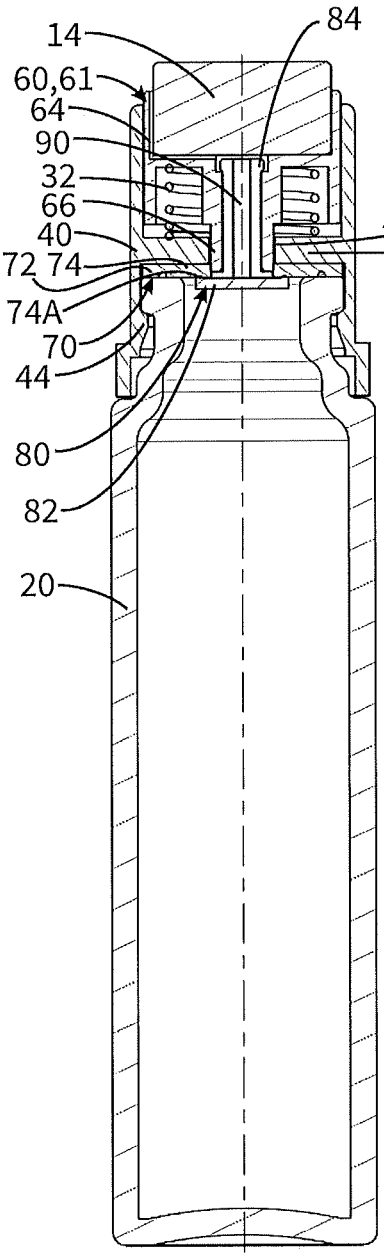
Figure 6:
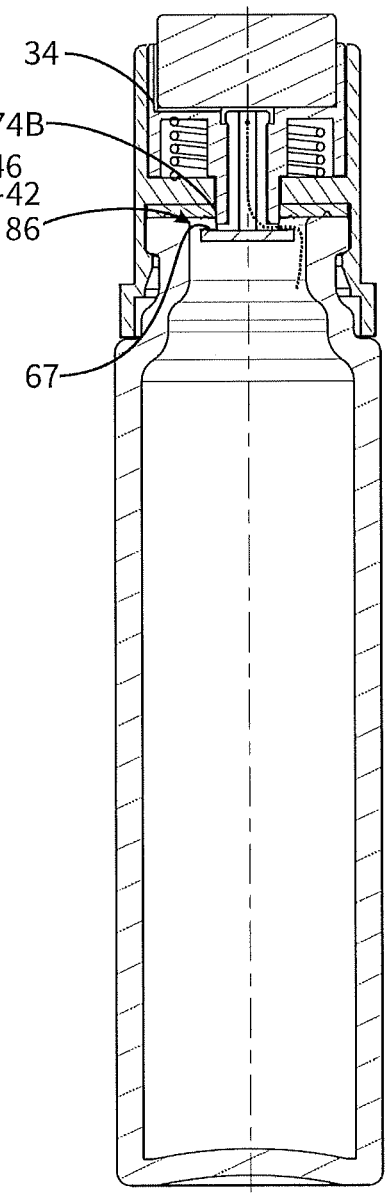
Figure 7:
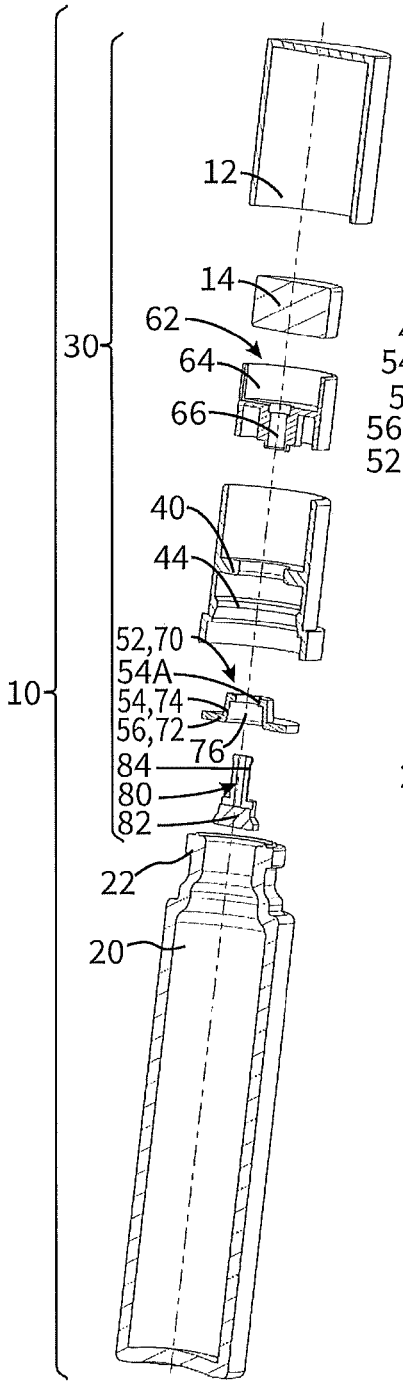
FIGS. 7 to 9 show a second variant of a sponge-type dispenser according to the invention in an exploded view and in sectional views in the state with the outlet valve closed and in the state with the outlet valve opened.
Figure 8:
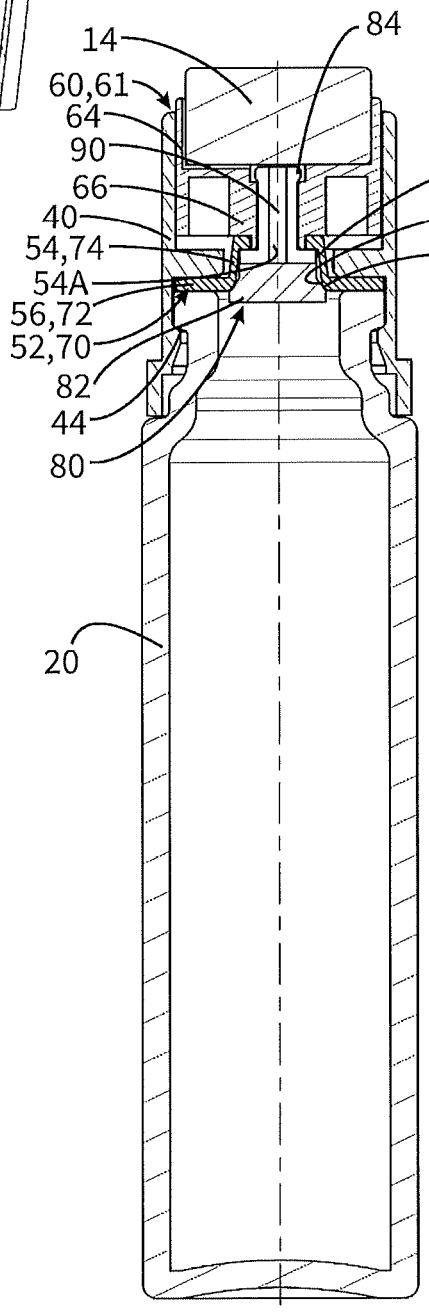
Figure 9:
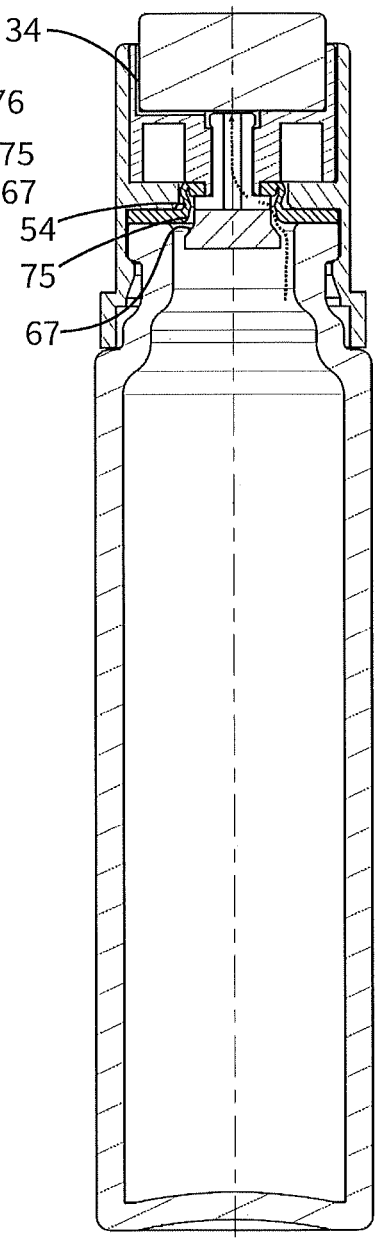

Two embodiments of the discharge head 30 are set out by way of example on the basis of FIGS. 4 to 6, on the one hand, and FIGS. 7 to 9, on the other hand.

First of all, regarding the first embodiment, shown in FIGS. 4 to 6 and corresponding to that of FIG. 3: The discharge head 30 of this embodiment has as its main component the base 40, which is configured with a coupling device 44 in the form of a latching coupling device, in order thereby to be snap-fitted onto the coupling nozzle 22 of the liquid storage means 20. For the purpose of sealing between the liquid storage means 20 and the base 40, a sealing component 70 is provided which, with an outer bottle-sealing portion 72, is clamped between base 40 and liquid storage means 20 for sealing purposes. The base 40 additionally has a horizontal wall 42, which is interrupted by an aperture 46. By means of this aperture 46, the sponge carrier 60 functioning as applicator portion 61 is secured on the base 40. For this purpose, the sponge carrier 60 has a first component 62 and a second component 80. The component 80 is slit in an upper pin segment, such that the latch portions arranged at the end of the two half-pins thus formed are deflectable relative to each other for the purpose of snap-fit connection to the component 62. Since a widened part 82 of the component 80 is arranged below the aperture 46 in the wall 42, and since the main portion of the sponge carrier 60, formed by component 62, is arranged above the aperture 46, the sponge carrier 60 is thus secured captively, but movably, on the base 40. A spring mechanism 52 in the form of a helical, spring, particularly preferably a relatively soft metallic helical spring, is inserted between the base 40, or the wall 42 of the base 40 interrupted by the aperture 46, and an underside of the component 62.

The liquid connection between the liquid storage means 20 and the sponge 14 is obtained by a liquid channel 90 inside the hollow connector 66, which is pushed in through the aperture 46. This liquid channel 90 extends from an inlet region, which is defined by the two components 62, 80 jointly, as far as the bottom of the bowl-shaped sponge receptacle 64.

In the closed state, which is shown in FIG. 5, a flow of liquid into this liquid channel 90 is not possible, since the widened part 82 of the hollow connector 66 bears, with a valve body face 67, from underneath on a valve sealing face 74A of the sealing component 70 and thus closes the outlet valve 86. When the sponge carrier 60 is pressed in, in the manner shown in FIG. 6, the hollow connector 66 is thus also pushed deeper into the liquid storage means 20. The widened part 82 at the lower end of the hollow connector 66, thus also the valve body face 67, detaches from the valve sealing face 74A of the sealing component 70, such that, with the liquid dispenser 10 suitably oriented, liquid can flow into the liquid channel 90. The path of the liquid is indicated by dots in FIG. 6. In this phase, an inner sliding seal face 74B of the sealing component 70, bearing on the outside of the hollow connector 66, prevents unwanted liquid from flowing out past the hollow connector 66.

During the discharging procedure, the discharged amount of liquid has to be replaced by air. To ensure that this air does not have to be sucked in through the sponge, a partially separate ventilation channel 34 is provided. In the region of the sponge receptacle 64, the ventilation channel 34 is introduced as a groove into the component 62 forming the sponge receptacle 64, wherein this groove is routed laterally past the sponge 14 and opens into the liquid channel 90. From there, the incoming air can flow through the liquid channel 90 into the liquid storage means 20 counter to the liquid.

In the embodiment according to FIGS. 7 to 9, the basic structure of the liquid dispenser 10 is substantially comparable to the first illustrative embodiment. Therefore, only the differences are explained below.

The embodiment according to FIGS. 7 to 9 does not have a separate helical spring. Instead, the sealing component 70 is configured such that it at the same time forms a spring mechanism 52. As can be seen in particular from FIG. 7, this sealing component 70, 52 is provided with an outer region 56 or outer bottle-sealing portion 72 which, correspondingly to the preceding illustrative embodiment, is clamped between the liquid storage means 20 and the base 40 for sealing purposes. To the inside of this, there is an elevation 54, which is provided centrally with an aperture 54A. The hollow connector 66 protrudes through this aperture 54A and is here secured by means of the component 80 with widened part 82. Thus, in contrast to the illustrative embodiment of FIGS. 4 to 6, the inner region of the sealing component 70 is positionally fixed in relation to the hollow connector 66. The mobility of the hollow connector is provided by the fact that the sealing component 70, which at the same time forms the spring mechanism 52, is inherently deformable.

To be able to obtain the desired valve function, a valve body face 67 is provided on the outside of the widened part 82 and, in the closed state of the outlet valve, bears internally on a valve sealing face 75 of the elevation 54.

If the sponge carrier 60 is now pressed down, this valve body face 67 retreats from the interior 76 of the elevation 54, whereby the contact between the valve body face 67 and the valve sealing face 75 ceases. At the same time, the elevation 54 is deformed in the manner illustrated in FIG. 9, such that there is no unwanted sealing elsewhere on the widened part 82 of the hollow connector 66. In the state according to FIG. 9, it is thus again possible for liquid to flow out of the liquid storage means 20 into the liquid channel 90 and thus to the sponge 14. The corresponding path of liquid is indicated by the dotted line.

Figure 10A:
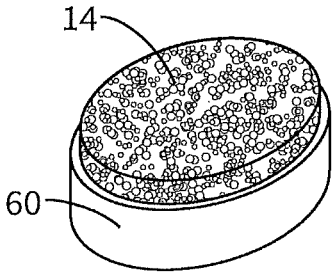
FIGS. 10A to 10K show particular sponge shapes.
Figure 10B:
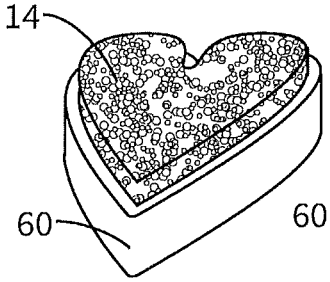
Figure 10C:
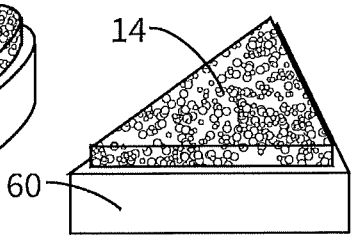
Figure 10D:
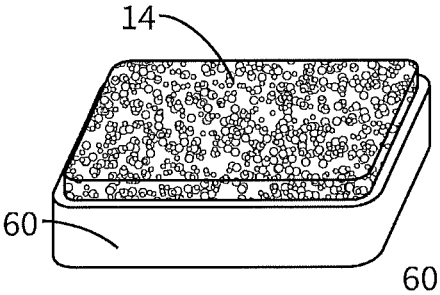
Figure 10E:
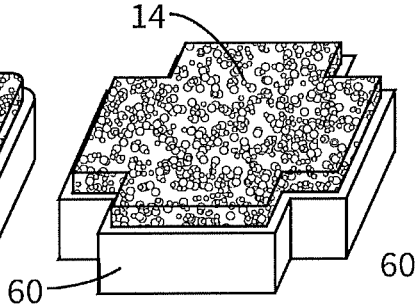
Figure 10F:
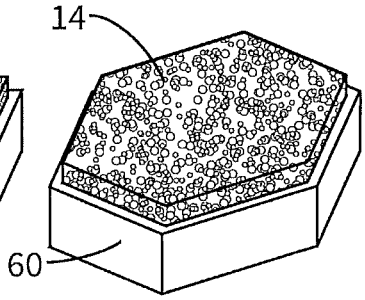
Figure 10G:
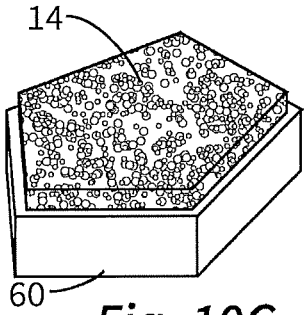
Figure 10H:
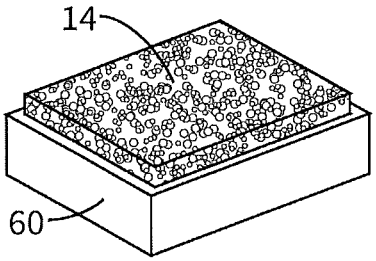
Figure 10I:
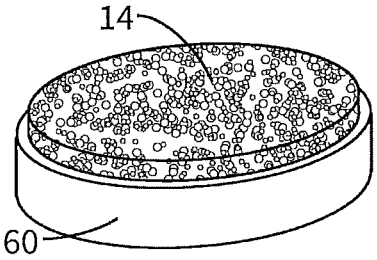

FIGS. 10A to 10K each show the sponge carrier 60 and sponge 14 with special shapes. Besides the simple round shape (FIG. 10A), the following are also considered to be advantageous: polygonal shapes (FIGS. 10C, 10E, 10F, 10G), elliptical shapes (FIG. 10I), diamond shapes (FIG. 10H) or motif shapes (FIG. 10B).

Figure 10J:
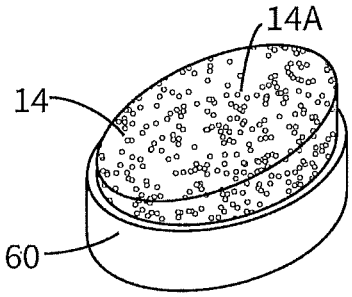
Figure 11:
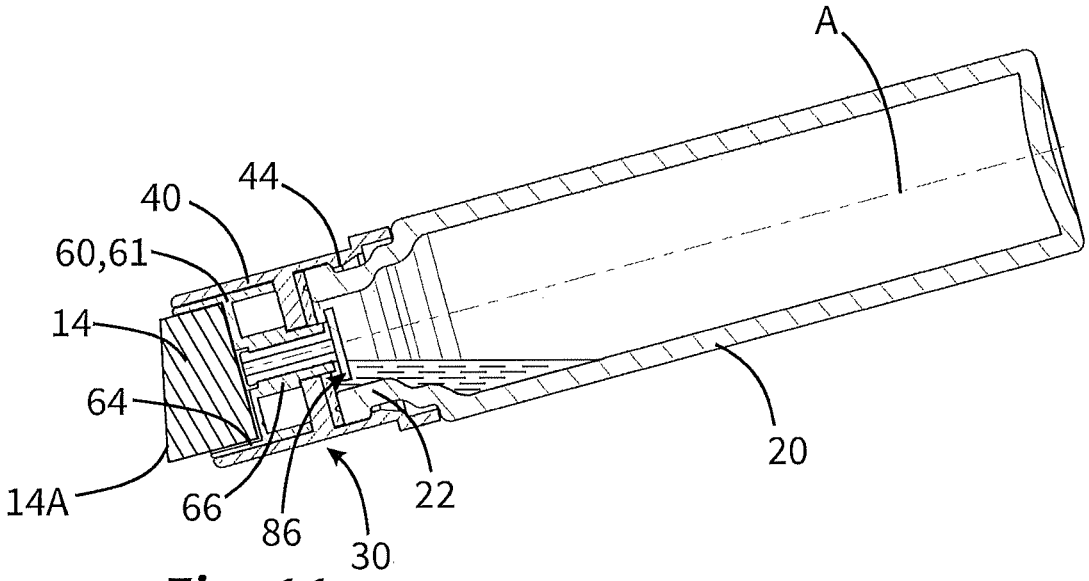
FIG. 11 illustrates the advantage afforded by the sponge shape from FIG. 10J during use.

FIG. 10J shows that an application face (14A) can also be set at an angle. FIG. 11 illustrates the advantage of this: Despite the slight downward orientation of the liquid dispenser 10, the application face 14A is oriented approximately vertically, ideally for applying makeup to a cheek for example.

Figure 10K:
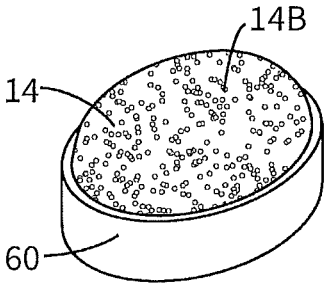

FIG. 10K shows a convex shape. A shape such as this is also advantageous as regards the orientation of the liquid dispenser for supplying the sponge 14 with liquid.

The invention claimed is:

1. A discharge head for a liquid dispenser for discharging cosmetic products, comprising:

a base to be secured to a liquid storage means;

the base having a coupling device for coupling to the liquid storage means;

a sponge carrier with a sponge receptacle in which a sponge is arranged;

the sponge carrier is being movable in a translationally guided manner with respect to the base;

the sponge carrier having a hollow connector inside which a liquid channel is provided that connects the liquid storage means to the sponge receptacle; and an outlet valve, which is assigned to the liquid channel and which can be opened by moving the sponge carrier in the direction of the base, such that liquid can flow freely out of the liquid storage means into the sponge receptacle.

2. The discharge head as claimed in claim 1, wherein:

the base, or a spring mechanism provided on the base, has an aperture through which the hollow connector of the sponge carrier protrudes; and the sponge carrier, at an end directed away from the sponge receptacle, has a widened part which, by form-fit engagement, counters a separation of the base or spring mechanism from the sponge carrier.

3. The discharge head as claimed in claim 2, wherein:

the sponge carrier has two separate components, which are mounted on each other in a positionally fixed manner; and a first of the two separate components of the sponge carrier has the sponge receptacle, and a second of the two separate components has the widened part.

4. The discharge head as claimed in claim 3, wherein:

the two components are connected to each other by a latch connection, wherein the first component has an outer sleeve of the hollow connector, and the second component has a latching portion which engages through the hollow connector and/or is latched inside the hollow connector.

5. The discharge head as claimed in claim 1, further including:

a spring mechanism which the sponge carrier is subjected to a force directing it the sponge carrier away from the base.

6. The discharge head as claimed in claim 5, wherein:

the spring mechanism has a spring plate with a central elevation, which spring plate is secured in an outer region to the base and is secured in the region of the elevation to the sponge carrier.

7. The discharge head as claimed in claim 6, wherein:

an aperture is provided in the spring plate in the region of the elevation, wherein liquid is conveyed to the sponge receptacle through the aperture.

8. The discharge head as claimed in claim 5, wherein:

the spring mechanism is configured as a helical spring and is arranged, to an outside of the hollow connector, between the sponge receptacle and the base.

9. The discharge head as claimed in claim 5, wherein:

the sponge receptacle has a bowl shape into which the sponge is placed; and/or the sponge is secured non-releasably in the sponge receptacle, or the sponge is configured as an exchangeable sponge and is held in the sponge receptacle only by force-fit engagement; and/or the spring mechanism is integrally connected to the base by multi-component injection molding.

10. The discharge head as claimed in claim 1, further including:

a ventilation channel, by which compensating air can flow from an environment into the liquid storage means after removal of liquid.

11. The discharge head as claimed in claim 10, wherein:

a sub-portion of the ventilation channel is provided between the sponge and a surface of the sponge receptacle facing toward the sponge; and/or a sub-portion of the ventilation channel is formed by the liquid channel; and/or the ventilation channel, from an environment-side inlet to a liquid storage means outlet, has a greater length than the liquid channel from an inlet to the liquid storage means to a sponge-side outlet.

12. The discharge head as claimed in claim 1, wherein:

the sponge has a Shore A hardness of at least 401 and/or the sponge, at an application face, is partially inclined with respect to a direction of movement of the sponge carrier, wherein at least 50% of the application face is inclined at a uniform angle; and/or the sponge, in a plane perpendicular to the direction of movement, has a shape which deviates from a circular shape and a rectangular shape.

13. A liquid dispenser for discharging cosmetic products, comprising:

the discharge head as claimed in claim 1;

wherein the liquid storage means has a coupling nozzle for coupling to the discharge head.

14. The liquid dispenser as claimed in claim 13, wherein:

the liquid storage means has a wall which is substantially rotationally symmetrical, or plane-symmetrical with respect to at least two planes, and which defines a central axis of the liquid storage means; and the discharge head and the liquid storage means are configured and adapted to each other in such a way that, with the outlet valve opened and with the discharge head oriented such that a central axis thereof encloses an angle of 15° with the horizontal, falling in a direction of the discharge head, at least 90% of the liquid, starting from a completely filled liquid storage means, can flow out through the outlet valve and a maximum of 10% remains as residual liquid in the liquid storage means.

15. The liquid dispenser as claimed in claim 13, wherein:

the liquid storage means is filled with a cosmetic liquid; and/or the hollow connector is arranged on the discharge head in such a way that, at least in a depressed state of an applicator portion or of the sponge carrier, the hollow connector protrudes into the liquid storage means.

16. A discharge head for a liquid dispenser for discharging cosmetic products, comprising:

a base to be secured to a liquid storage means;

the base having a coupling device; and an applicator portion which is movable in a translationally guided manner with respect to the base;

the applicator portion having a hollow connector inside which a liquid channel is provided by way of which the applicator portion can be fed with liquid from the liquid storage means;

at least one outlet valve, which is assigned to the liquid channel and which interrupts a supply of liquid to the applicator portion; and a one-piece sealing component on the coupling device, said sealing component having a peripheral bottle-sealing portion by which a contact region between the base and the liquid storage means is sealed off from an environment; and the sealing component has an inner sealing portion which interacts with the hollow connector in such a way that:

a sliding sealing face on the inner sealing portion interacts with an outer face of the hollow connector in such a way that, during translational movement of the hollow connector with respect to the inner sealing portion, no liquid can flow between the sliding sealing face and the outer face of the hollow connector, and/or a valve body face provided on the hollow connector bears, in an end position of the applicator portion, on a valve sealing face of the inner sealing portion in such a way that the liquid channel is thereby interrupted.

17. The discharge head as claimed in claim 16, wherein:

the hollow connector, at an end facing in a direction of the coupling device, has a widened part on which the valve body face is provided, wherein this valve body face can be lifted, by movement of the hollow connector, away from the valve sealing face of the inner sealing portion.

18. The discharge head as claimed in claim 16, wherein:

the hollow connector is secured to the inner sealing portion of the sealing component;

the inner sealing portion of the sealing component has a sealing structure which rises above a plane of the bottle-sealing portion and which defines an interior; and the valve body face on the hollow connector is provided on a valve portion of the hollow connector arranged in an interior defined by the sealing structure.

* * * * *